United States Patent [19]

Wedell

[11] 4,080,893

[45] Mar. 28, 1978

[54] INK SCOOP SQUEEGEE ASSEMBLY

[75] Inventor: David A. Wedell, Sparta, Mich.

[73] Assignee: James A. Black, Sparta, Mich.

[21] Appl. No.: 730,307

[22] Filed: Oct. 7, 1976

[51] Int. Cl.[2] ..... B41F 15/44

[52] U.S. Cl. ..... 101/124; 101/123

[58] Field of Search ..... 101/119, 120, 123, 124, 101/126; 118/213, 407, 406, 413, 411, 412, 415; 401/270, 274

[56] References Cited

U.S. PATENT DOCUMENTS

| | | | |
|---|---|---|---|
| 2,963,964 | 12/1960 | Klump | 101/123 |
| 3,731,623 | 5/1973 | Bubley et al. | 101/123 X |
| 3,988,986 | 11/1976 | Zimmer | 101/119 |

*Primary Examiner*—Ronald E. Suter

*Attorney, Agent, or Firm*—Price, Heneveld, Huizenga & Cooper

[57] ABSTRACT

A squeegee assembly for stencilling apparatus employing cooperative front and rear panels astraddle the squeegee, the panels being shiftable between (1) an extended condition away from the squeezee and in which such cooperatively form an open bottom chamber for the stencilling fluid about the squeegee, and also the rear panel serves as a flow coater and the front panel serves as a fluid barrier, and (2) a retracted position at the squeegee to close the fluid chamber about the squeegee.

5 Claims, 11 Drawing Figures

INK SCOOP SQUEEGEE ASSEMBLY

BACKGROUND OF THE INVENTION

This invention relates to stencilling apparatus, and more particularly to a stencilling assembly with control of the stencil fluid.

In recent years, several developments have been made in squeegee assemblies of stencilling apparatus to obtain better control of the stencil fluid characteristics during continued stencilling. Many of such developments have been directed to features for controlling the viscosity of the fluid by limiting exposure of the fluid to minimize solvent evaporation, by controllably adding solvent to the fluid for viscosity stabilization, by operating the squeegee while submerged under a pool of fluid, by flow coating directly behind the squeegee during the stencilling stroke, and others. Typical ones of these developments are set forth in U.S. Pat. No. 3,252,411, application Ser. No. 519,539, filed 10/31/74, now U.S. Pat. No. 3,980,017 issued Sept. 14, 1976, application Ser. No. 518,768, filed 10/29/74, now U.S. Pat. No. 3,973,491 issued Aug. 10, 1976, and application Ser. No. 688,610, filed 5/21/76.

However, even with some of these improved devices, during the stencilling operation the relative movement occurring between the squeegee and the stencil screen (usually by moving the stencil screen past the squeegee), causes the stencil fluid to steadily accumulate on one end of the stencil where the squeegee stops at the end of the stencilling stroke. The accumulated fluid, usually ink, becomes viscous, thereby becoming not only useless but also presenting a cleaning problem. And, at high printing speeds, the ink is sometimes actually pushed or splashed against the end of the stencil frame to create further difficulties.

SUMMARY OF THE INVENTION

This invention was conceived and developed to achieve control of the stencilling fluid and its stencilling characteristics during repeat stencil strokes, even of the fluid pushed ahead of the squeegee. The fluid is retained within a confined chamber formed by cooperative front and rear panels straddling the squeegee and shiftable between extended and retracted conditions. The special front panel, in addition to its cooperative action with the rear panel in forming the chamber, forms a barrier to the excess fluid ahead of the squeegee when extended. It also retrieves this fluid when shifting to its retracted condition at the end of the stencilling stroke. The rear panel, in addition to its cooperative action with the front panel, spreads fluid during stencilling for the succeding stencilling stroke. The two panels, retracted to the squeegee, cooperate with the squeegee to form a closed bottom fluid chamber about the squeegee, enabling the squeegee to be of suspended submerged type with flow passage means thereabove in the squeegee support.

The front and rear panels advance with the squeegee, that is, relative to the stencil, but spaced from the squeegee, during the stencilling stroke, and return with the squeegee in a fluid retaining relationship therewith on the return stroke. This relative movement may be and usually is achieved by shifting the stencil while retaining the squeegee and panels generally stationary.

These and other special advantages, features, and objects of the invention will be apparent from the following detailed description.

DESCRIPTION OF THE PREFERRED EMBODIMENT

Figure 3:
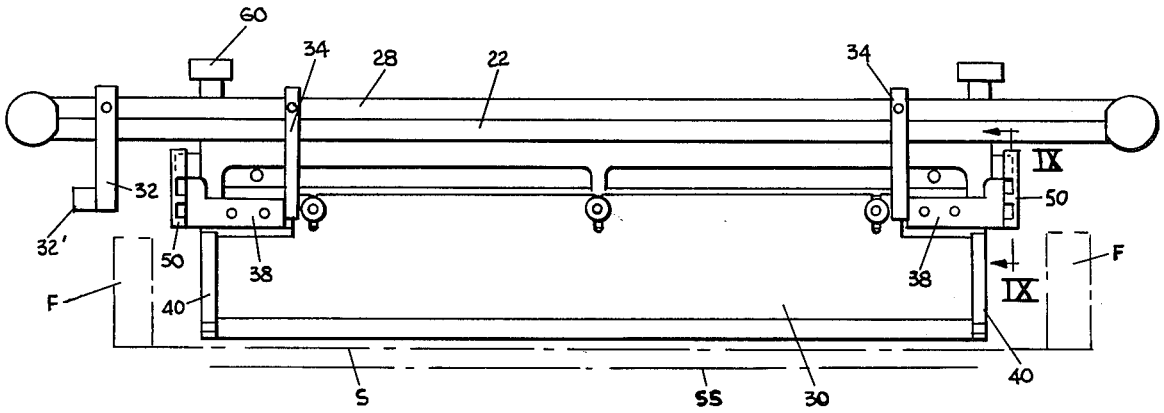
FIG. 3 is a front elevational view of the apparatus.

Referring now specifically to the drawings, the squeegee assembly 10 there depicted is used in combination with a stencil screen S (FIG. 3) retained in a typical stencil screen frame F, both shown in phantom, and for example of the type set forth in U.S. Pat. Nos. 3,359,663, 3,273,497, or 3,779,160. The squeegee assembly extends transversely across and above the stencil so that, with relative horizontal movement between the stencil screen and the squeegee, usually by shifting of the stencil screen in one direction for stencilling and then in the opposite direction for return, the squeegee will cause stencilling fluid to be forced down through the open pattern areas of the stencil screen, all in known fashion. For convenience, this relative movement between the squeegee and stencil in one direction and then the other will be indicated as the "stencilling stroke" or "advance stroke" of the squeegee and the "return stroke" of the squeegee, regardless of which one of the squeegee and stencil is moved to cause this relative movement. Also, in conventional fashion, the stencil is vertically separated from the squeegee on the return stroke by elevating the squeegee and/or lowering the stencil. The stock to be stencilled, e.g. sheet stock or web stock of paper, plastic, laminates, or a variety of these and/or other materials, is supported on a conventional stock support surface which may be flat or curvilinear, beneath the stencil screen. A typical curvilinear stock support surface is shown in U.S. Pat. No. 3,779,160. A suitable flat bed support surface is shown in U.S. Pat. No. 3,650,207. In conventional fashion as set forth in these prior teachings, the stencil is vertically separated from the stock on its underlying surface on the return stroke. The stock is advanced in conventional fashion.

Figure 11:
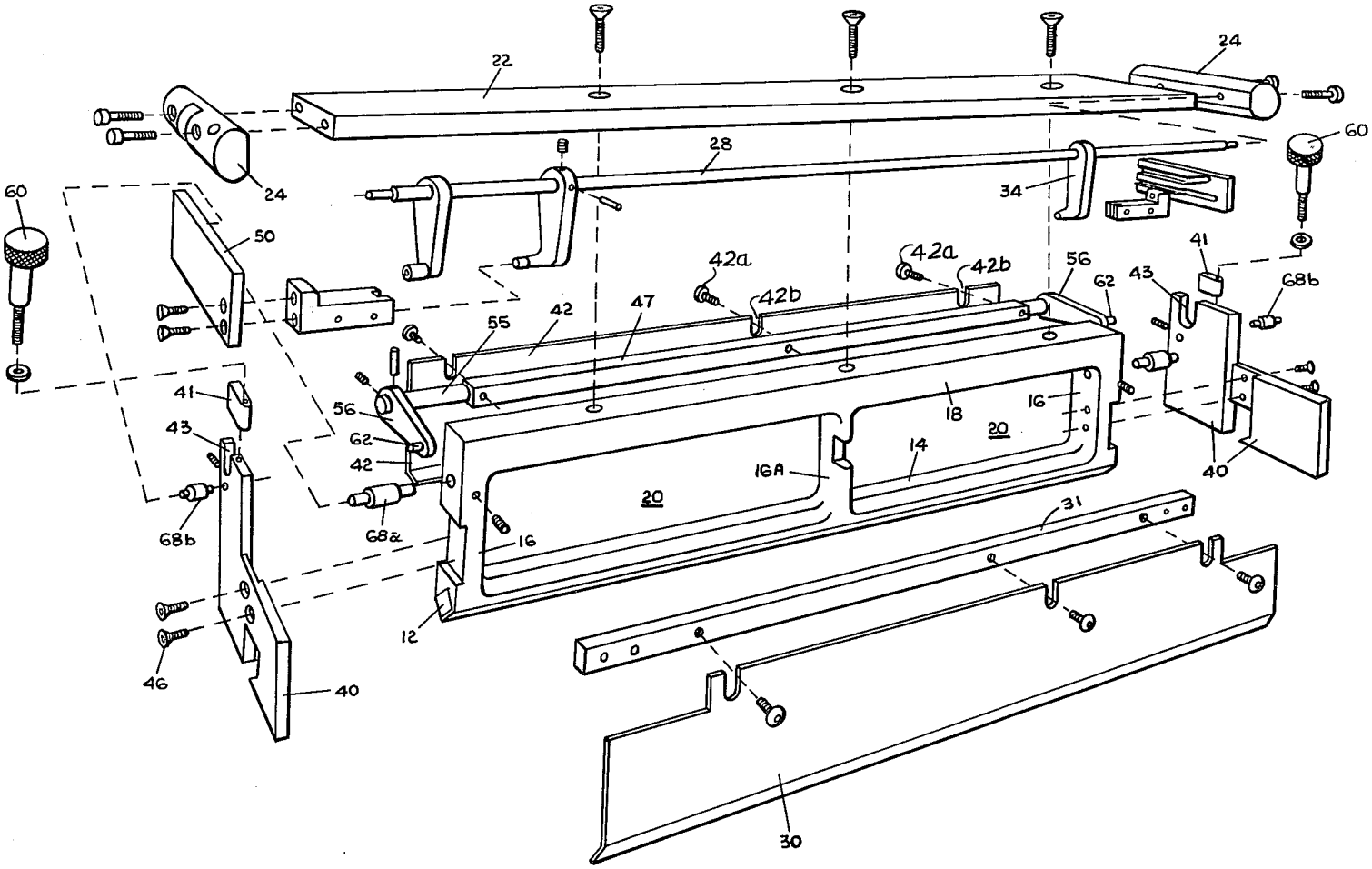
FIG. 11 is an exploded perspective view of the apparatus.

A central element in the stencilling assembly is the resilient squeegee element 12, typically of rubber or the equivalent. This squeegee element, here shown to be roughly square in cross section, extends transversely across the stencil screen. It is supported in a correspondingly shaped elongated cavity of a depending squeegee retainer 14 such that the functioning edge of squeegee element 12 extends below the lower portion of retainer 14. Extending upwardly from the ends of retainer 14 is a pair of spaced vertical suspension colums 16. These columns may be integral with retainer 14. The upper ends of columns 16 are secured to and preferably integral with a support bar 18. Bar 18 extends horizontally and transversely across the assembly, parallel to retainer 14 and spaced vertically therefrom, to define a large open space 20 outlined by retainer 14 and bar 18 on the bottom and top respectively, and by upright supports 16 on the ends. Depending upon the length of the squeegee, one or more supplemental columns may be employed such as the central column 16A (FIG. 11) between retainer 14 and bar 18, through opening 20.

Secured to and extending across bar 18 is an elongated horizontal support beam 22 having couplers 24 on the opposite ends thereof for releasably engaging with suitable mounting brackets (not shown) on the stencilling machine.

Figure 1:
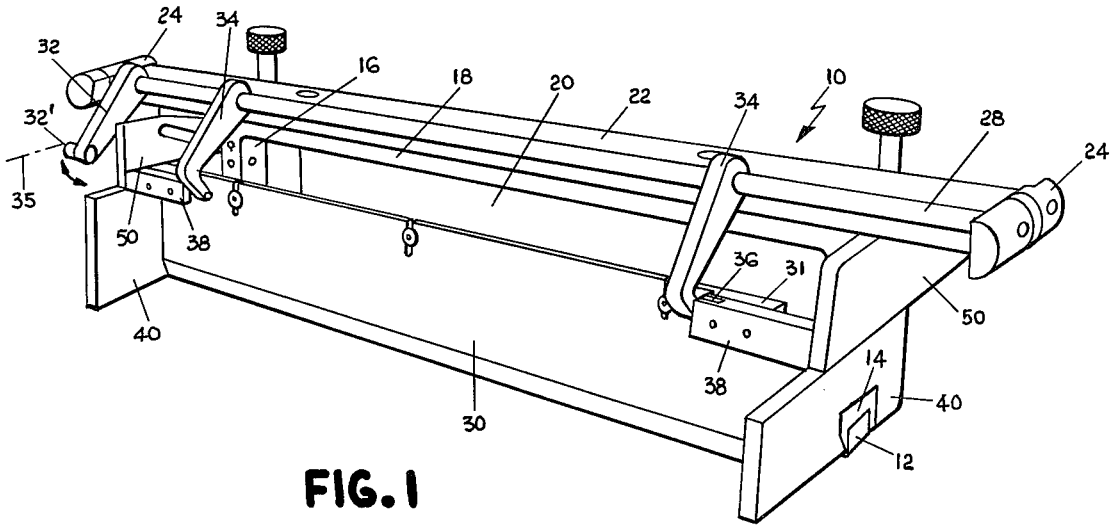
FIG. 1 is a perspective view of the novel assembly, viewed from the front with the panels in the extended condition.
Figure 2:
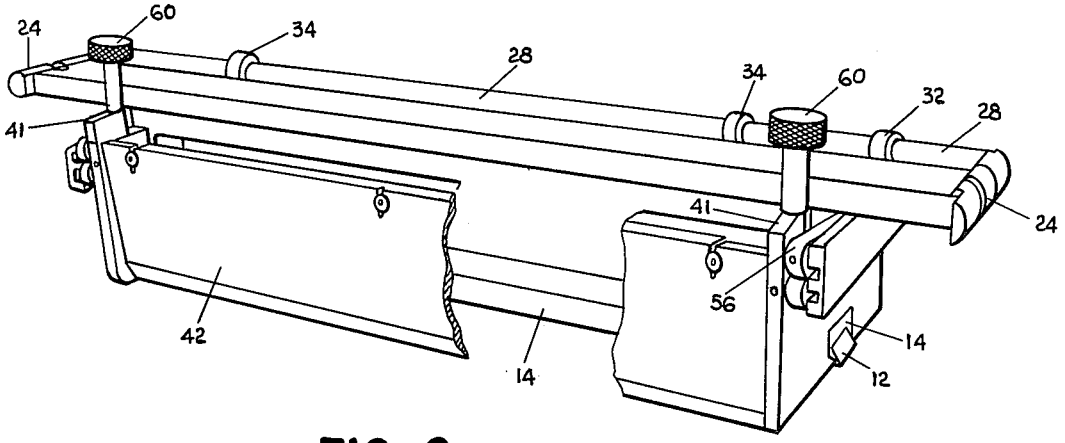
FIG. 2 is a perspective view of the assembly, viewed from the rear with the panels in extended condition.

Couplers 24 also support the pivotal ends of a transverse shaft 28 parallel to beam 22. This shaft is employed to shift one of the two dual purpose panels, namely front panel 30 in the depicted embodiment, using pivotal links 34. More specifically, an actuator link 32 having one end affixed to pivot shaft 28 extends radially away therefrom for attachment of its opposite ends 32' (FIG. 1) to a power actuator. This power actuator is here represented by the phantom line 35, and may be a fluid actuator such as a fluid cylinder, a mechanical actuator, an electrical actuator such as a solenoid, or other suitable means for shifting link end 32' through an arc for pivoting shaft 28. Pivoting of shaft 28 causes pivoting of links 34, each having one end affixed to shaft 28 and the other end of which has a roller 34' engaged in respective vertical slots 36 of blocks 38 attached to the outer face of front vertical panel 30. These vertical slots 36 capture the rollers to allow shifting of the panel back and forth. I.e., panel 30 is shifted between its extended condition and retracted condition with arcuate movement of links or dogs 34 upon pivoting of shaft 28 with actuator 32.

Squeegee 12 and squeegee retainer 14 are encompassed by panels, including two fixed end panels 40, and the two specially movable front and rear panels 30 and 42, respectively. Each of these latter two panels has more than one function. The front panel 30 is specially shiftable from an extended condition away from the squeegee at which it forms a fluid barrier, to a retracted position at the squeegee at which it cooperates with rear panel 42 to form a closed fluid retaining chamber about the squeegee and squeegee retainer. Further, during the shift from its extended to its retracted condition, the front panel serves to scoop up and retrieve excess fluid in front of the squeegee at the end of the stencilling stroke, as further described hereinafter. In its extended position, front panel 30 is elevated a small controlled amount so that its lower edge will not interfere with the layer of ink flow coated by the rear panel on the previous stencilling stroke. Rear panel 42 in its extended position forms a flow coater which operates as such during stencilling, and in its retracted position at the squeegee cooperates with the front panel 30 to close the chamber and retain ink during the return stroke.

In the embodiment depicted, rear panel 42 basically moves through a pivotal motion between its extended and retracted conditions, while front panel 30 moves through a compound linear motion between its extended and retracted positions, as controlled by a camming mechanism described hereinafter so that its lower edge is lower in the retracted position than in the extended position.

End panels 40, secured to the respective upright columns 16 as by threaded fasteners such as Allen screws 46 (FIG. 4), laterally confine the stencilling fluid. These panels extend to the front and also to the rear of the squeegee 12 to encompass panels 30 and 42 in the extended condition as well as the retracted condition. They cooperate with panels 30 and 42 to confine the stencilling fluid.

Vertical rear panel 42 basically comprises a plate member having a lower edge portion 42' which serves as a flow coater. The vertical spacing of this lower panel edge from the stencil can be pre-set to an adjusted amount by loosening threaded fasteners **42*a* (FIG. 11) (which extend through vertical slots 42*b* of panel 42 to secure it to support bar 47), and vertically shifting the panel. This regulates the thickness of flow coated fluid that flows beneath the panel as described hereinafter. Lower edge portion 42' projects on an acute angle toward the squeegee so as to engage squeegee retainer 14 (FIG. 4 and FIG. 10) in the retracted condition of the panel for retaining ink or other stencilling fluid at and about the squeegee and squeegee retainer. Front plate 30 has a mount bar 31 along its upper edge and which is suspended at its opposite ends by blocks 38. These blocks are in turn fixedly secured to a pair of vertical cam plates 50 extending transversely of main support 28, i.e. parallel to the stencilling direction, and lying adjacent the outer faces of upright columns 16 and end plates 40. A cooperative cam and cam track relationship is obtained using these cam plates, for effecting controlled movements of panels 30 and 42. Cam plates 50 move with movement of the upper end of panel 30**.

Rear panel 42 also constitutes a generally vertical, solid plate, the lower portion of which projects at an acute angle toward the squeegee and squeegee retainer so that shifting of panel 42 to the retracted condition causes the lower edge 42' to engage the squeegee retainer 14 (FIG. 10) generally simultaneously with engagement of the lower edge portion of panel 30 with the retainer, to form a closed bottom chamber about the squeegee and squeegee retainer. The stencilling fluid is thus confined (FIG. 10) between front panel 30, rear panel 42, and end plates or panels 40, and generally above and in front of squeegee retainer 14.

Figure 9:
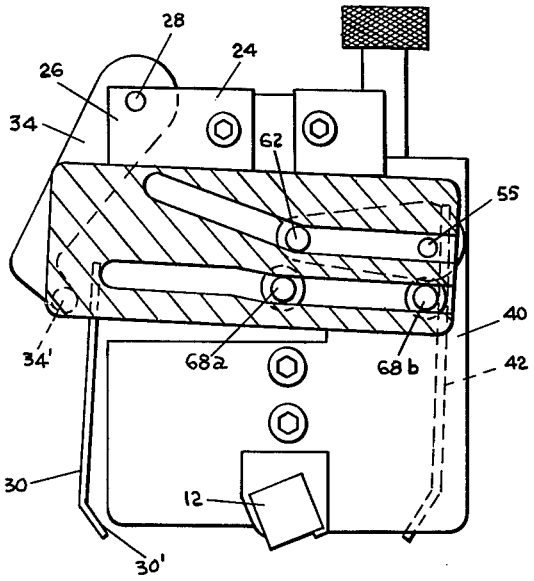
FIG. 9 is a sectional view taken on plane IX—IX of FIG. 3, showing the panels in extended condition.

The upper edge of panel 42 is attached to a support bar 47 which is mounted to a pair of pivotal end shafts 55 that extend into and through the end plates 40 for support. Specifically, these end shafts are retained in cooperatively shaped recesses 43 (FIG. 11) formed in the top of end plates 40. Retention is by a pair of bearing caps 41 bolted to end plates 40 over the top of the recesses by a pair of fastener elements 60. The opposite end shafts 55 project outwardly beyond end plates 40 at which a pair of respective pivotal links or arms 56 are attached thereto. Each link 56 has one end on one of these shafts, and the opposite end including a cam follower 62 which rides in the upper cam track slot 64 formed in the inside face of cam plate 50. Cam tracks 64 in the two cam plates are the mirror image of each other. Each cam track 64 has a horizontal portion extending toward the rear of the assembly, and an upwardly forwardly slanted portion toward the front of the assembly. Thus, when cam plate 50 is shifted toward the rear, cam follower 62 on link 56 will be elevated to cause link 56 to pivot. This causes pivoting of end shafts 55 to which the links are attached, thereby pivoting bar 47 and rear panel 42 from an extended condition, (FIG. 9) to a retracted condition (FIG. 10) at which the lower edge 42' of panel 42 is brought into abutting relation with squeegee retainer 14.

Positioned below cam track 64 in the inside face of each cam plate 50 is a second cam track slot 66 having front and rear portions, both generally horizontal in orientation. The rear portion is offset slightly downwardly relative to the front portion through a diagonal intermediate portion. These two cam tracks 66 in the two cam plates are also the mirror image of each other. Positioned within each of these lower cam tracks 66 is pair of spaced, roller type, cam folowers **68*a* and 68*b* mounted on the outer face of columns 16 and end plates 40. Thus, simultaneous shifting of the cam plates from the rearward position (FIG. 10) at which the front panel 30 is retracted adjacent the squeegee retainer, to the forward position (FIG. 9) at which the front panel 30 is extended away from the squeegee and retainer, causes cam plate 50 to be elevated a small controlled amount. This elevates front panel 30 when in its extended position, to raise its lower edge 30' slightly above the level of the stencil screen a small controlled amount. The space between the edge 30' and the stencil screen allows panel 30** to clear the flow-coat applied on the previous stencilling stroke.

Lower edge 42' serves as a flow coater during the stencilling stroke. I.e., the stencilling fluid is retained by panel 42 except for the noted controlled flow as movement occurs between the stencil screen, and the squeegee and flow coating panel.

OPERATION

In employing the novel apparatus in a stencil screen press, a stencil screen S on a frame F is located above a stock support surface SS (FIG. 3) which can be flat or curvilinear. The mechanism 10 is supported above the stencil screen by couplers 24 which are releasably connected to suitable brackets (not shown) on the press. Relative movement is caused to occur between assembly 10 and the underlying stencil screen by moving the stencil screen, or the assembly 10, or both, typically the former. This movement is in one direction for the stencilling stroke and then in the opposite direction for the return stroke. During the stencilling stroke, assembly 10 is lowered to cause the bottom edge of squeegee element 12 to engage the stencil screen while the screen engages the supported stock to be printed. On the return stroke, the stencil screen and squeegee are vertically separated by elevating assembly 10, or lowering the stencil screen and its frame, or both, all in conventional fashion.

Figure 4:
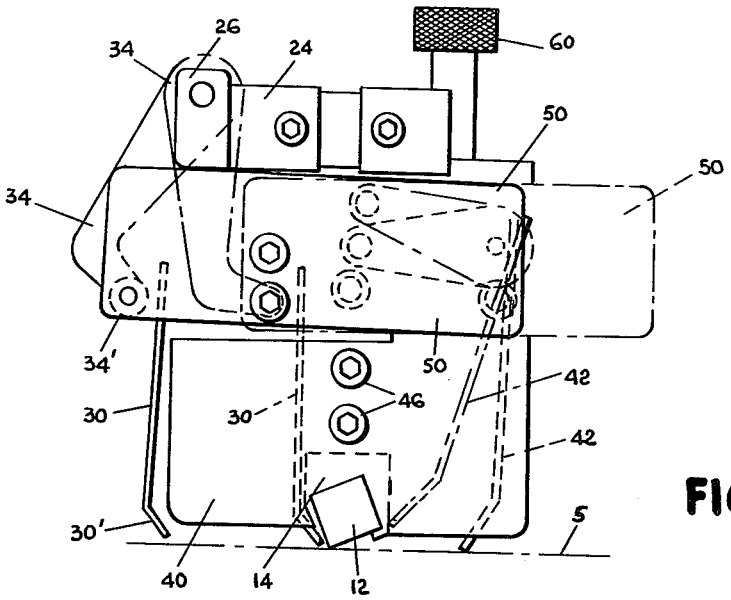
FIG. 4 is an end elevational view of the apparatus in FIG. 1, the panels being shown in extended condition with solid and dashed lines, and shown in the alternate retracted condition with phantom lines.
Figure 5:
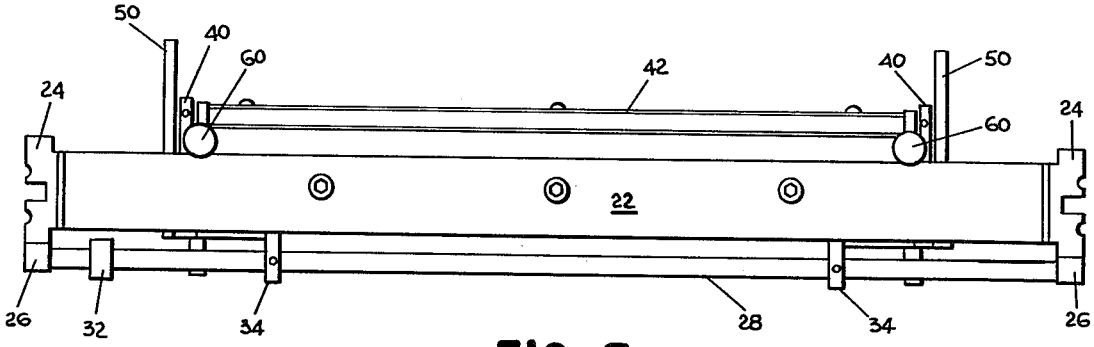
FIG. 5 is a plan view of the apparatus in FIG. 3.
Figure 6:
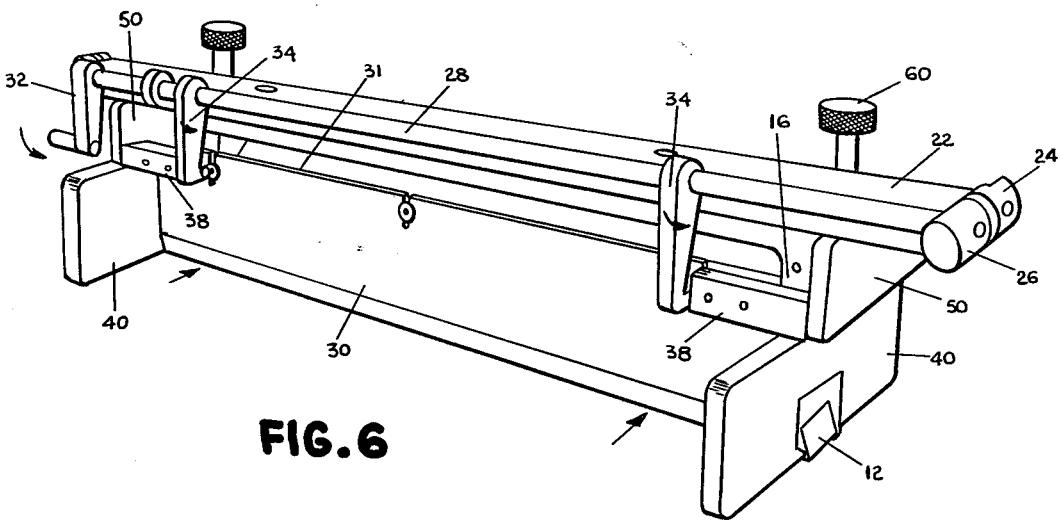
FIG. 6 is a perspective view of the apparatus in FIG. 1, from the front with the panels in retracted condition.
Figure 7:
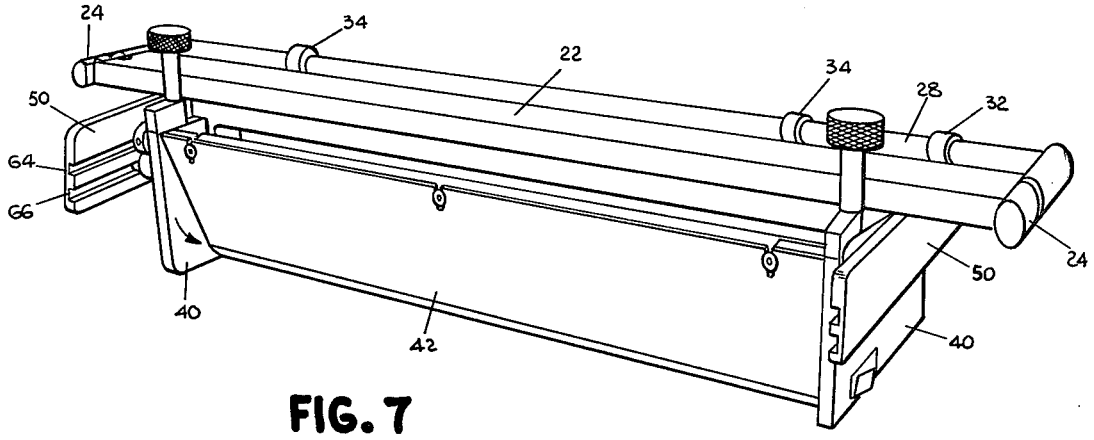
FIG. 7 is a perspective view from the rear, with the panels in retracted condition.
Figure 8:
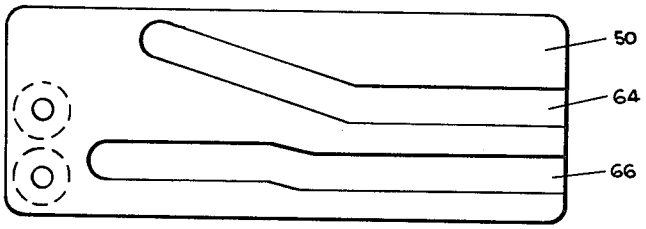
FIG. 8 is an enlarged elevational view of one of the two cam plates of the apparatus.
Figure 10:
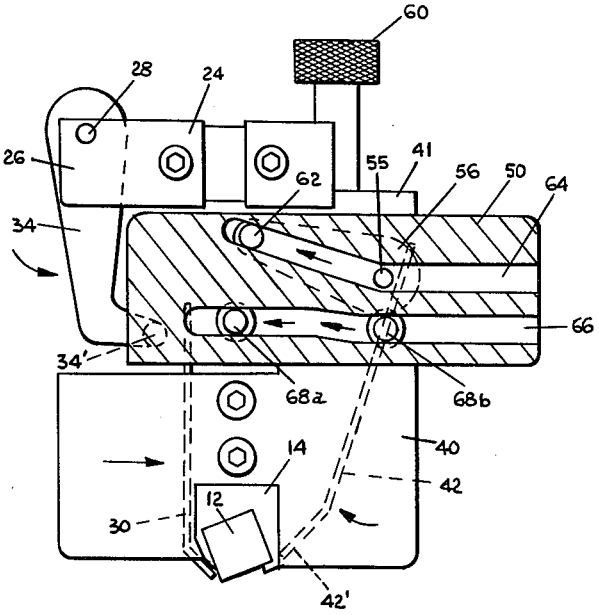
FIG. 10 is a sectional view comparable to FIG. 9, but with the mechanism shifted to place the panels in a retracted condition.

During the stencilling stroke, rear panel 42 and front panel 30 are in the extended condition (FIGS. 1, 2, 4 and 9). During the return stroke, panels 42 and 30 are in the retracted condition adjacent squeegee 12 and engaging squeegee retainer 14 (FIGS. 4, 6 and 10).

During the stencilling operation, the first stencilling stroke will not result in stencilling fluid being forced through the squeegee screen because the stencilling fluid will not yet have been spread upon the stencil. An excess of such fluid is, however, placed within the chamber 35 defined between front and rear panels 30 and 42 and end panels 40. During the first stroke, therefore, (see FIG. 4), squeegee 12 will advance in engagement with the stencil screen but without forcing fluid through the screen, while a controlled thickness layer of fluid is released beneath lower edge 42' for the next stencilling stroke. For clarity, the succeeding stencilling strokes will be described.

As the assembly is shifted through a stencilling stroke, the lower edge of squeegee 12 engaging the stencil forces some of the pre-coated fluid through the pattern areas of the stencil screen onto the underlying stock. The excess ink flowing ahead of the squeegee element is retained by front panel 30 while a portion of the excess can flow through passage 20. Some of the fluid flows beneath flow coater edge 42' onto the stencil screen behind the assembly to flow coat the fluid for the next stencilling stroke. Toward the end of the stroke, i.e. as the end of the stencil screen is approached, actuator 35 is activated to cause front panel 30 to retract while the squeegee element completes the stroke, scooping up excess ink in front of the squeegee. As the front panel retracts, it also lowers the controlled amount toward the stencil to aid in this scooping action. Simultaneously, rear panel 42 is shifted towards the squeegee, scooping excess of ink behind the squeegee. The excess fluid is retained around the squeegee and its retainer in the now closed-bottom chamber.

In detail, this panel shifting occurs as follows:

Actuator 35 shifts link 32 downwardly, rotating shaft 28 and forcing links 34 downwardly and toward the center of assembly 10. This causes links 34 to shift front panel 30 toward squeegee 12 and into engagement with squeegee retainer 14.

Shifting of front panel 30 towards the squeegee, by links 34 causes attached blocks 38 and cam plates 50 to also be shifted simultaneously. This advances the cam tracks 64 and 66. Advancing of cam track 64 causes cam followers 62 to ride through the horizontal portion of the cam track and up the vertical diagonal incline, thereby pivoting arms 56, causing pivoting of shaft 55 on which such are mounted. This pivoting of shaft 55 rotates bar 47 and thus attached rear panel 42, causing its lower edge to engage squeegee retainer 14 and close the bottom of the chamber at the rear portion thereof. This pivotal movement of panel 42 also scoops up any excess ink behind the squeegee 12 into this closed chamber. The previously noted advancement of cam plates 50 (from the position in FIG. 9 to the position in FIG. 10) causes the cam plates to be lowered as the cam tracks 66 move from a first position where followers **68*a* and 68*b* are in the lower portion of the cam track, to the second position where the followers are in the vertically upwardly offset portion of the cam track. This lowering of the cam plate causes the controlled lowering of the front panel 30 attached to the cam plate through blocks 38 and bar 31 such that the front panel scoops up any excess ink on the screen between the front panel and the squeegee, and forces it into the now closed bottom chamber around the squeegee. Assembly 10 is then lifted and/or stencil screen S is lowered for the return stroke during which the squeegee assembly is returned, in a closed, fluid retaining condition, to the starting position at the opposite end of the stencil screen. The assembly is then again shifted vertically to place squeegee 12 down in engagement with the stencil screen, at which time actuator 34 is shifted in the opposite direction as previously described, to reverse the front panel 30, cam plates 50 with their cam tracks, and thus rear panel 42. This moves panels 42 and 30 away from the squeegee and retainer to open the bottom of the chamber while again raising panel 30** a controlled amount.

The novel apparatus has proven highly effective and advantageous. Although many of its advantages are set forth, others will be apparent to those in the art, as well as certain modifications to suit particular circumstances or equipment. The invention is intended to be limited only by the appended claims and the reasonable equivalents thereto.

The embodiments of the invention in which an exclusive property or privilege is claimed are defined as follows.

1. A squeegee assembly for use with a stencil frame mounting a stencil screen, comprising:

support means for supporting the squeegee assembly in a stencil frame;

a squeegee retainer suspended from and spaced below said support means and configurated to retain a resilient squeegee element for cooperative relationship with the stencil screen;

a pair of spaced, end members at opposite ends of said squeegee retainer to retain stencilling fluid;

a pair of front and rear closure panels astraddle of said squeegee retainer, means operatively coupled with both of said front and rear closure panels for shifting said front and rear closure panels simultaneously between a cooperative retracted condition at said squeegee and squeegee retainer, forming a closed chamber for stencil fluid around said squeegee, and an extended condition with both said front and rear closure panels spaced from said squeegee retainer to form an open bottom chamber; said means for shifting including camming means comprising cam surfaces and cam surface followers connected to one of said front and rear panels, and second cam surfaces and cam surface followers connected to the other of said front and rear panels.

2. A squeegee assembly for use with a stencil frame mounting a stencil screen, comprising:

support means for supporting the squeegee assembly in a stencil frame;

a squeegee retainer suspended from and spaced below said support means and configurated to retain a resilient squeegee element for cooperative relationship with the stencil screen;

a pair of spaced, end members at opposite ends of said squeegee retainer to retain stencilling fluid;

a pair of front and rear closure panels astraddle of said squeegee retainer, means operatively coupled with both of said front and rear closure panels for shifting said front and rear closure panels simultaneously between a cooperative retracted condition at said squeegee and squeegee retainer, forming a closed chamber for stencil fluid around said squeegee, and an extended condition with both said front and rear closure panels spaced from said squeegee retainer to form an open bottom chamber; said front panel in its extended condition forming a fluid retaining splash panel, and said rear panel forming a flow coater.

3. A squeegee assembly comprising:

a stencilling-fluid chamber having spaced, generally vertical front and rear panels, and cooperative end panels;

a squeegee retainer and squeegee between said front and rear panels and between said end panels;

means for simultaneously shifting said front and rear panels between an extended position both spaced from said squeegee retainer and squeegee to form an open bottom chamber for stencilling, and a retracted position at said squeegee retainer and squeegee to form a closed bottom fluid retaining chamber; said front and rear panels having portions extending vertically above portions of said squeegee retainer to cause said chamber to have portions in front of, to the rear of, and above said squeegee retainer portions.

4. A squeegee assembly comprising:

a stencilling-fluid chamber having spaced, generally vertical front and rear panels, and cooperative end panels;

a squeegee retainer and squeegee between said front and rear panels and between said end panels;

means for simultaneously shifting said front and rear panels between an extended position both spaced from said squeegee retainer and squeegee to form an open bottom chamber for stencilling, and a retracted position at said squeegee retainer and squeegee to form a closed bottom fluid retaining chamber; said rear panel and said panel and said panel shifting means being operatively interconnected to elevate said front panel slightly when said panels are extended, to cause said front panel to clear the fluid flow coated during the previous stencilling stroke.

5. The apparatus in claim 4 wherein said panel shifting means includes cam tracks and followers to so elevate said front panel.

* * * * *

UNITED STATES PATENT AND TRADEMARK OFFICE

CERTIFICATE OF CORRECTION

PATENT NO. : 4,080,893
DATED : March 28, 1978
INVENTOR(S) : David A. Wedell

It is certified that error appears in the above-identified patent and that said Letters Patent are hereby corrected as shown below:

Column 1, line 53:
"succeding" should be ---succeeding---

Column 3, line 4:
"colums" should be ---columns---

Column 5, line 14:
After "is" insert ---a---

Column 5, line 15:
"folowers" should be ---followers---

Column 8, line 41:
After the first occurrence of "panel" delete "and said panel"

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*